US005986196A

United States Patent [19]

Behrenfeld

[11] Patent Number: 5,986,196

[45] **Date of Patent: *Nov. 16, 1999**

[54] IMPACT PAD FOR A DRUM HEAD

[76] Inventor: Eric J. Behrenfeld, 1737 N. Paulina, Unit 107, Chicago, Ill. 60622

[ * ] Notice: This patent issued on a continued prosecution application filed under 37 CFR 1.53(d), and is subject to the twenty year patent term provisions of 35 U.S.C. 154(a)(2).

[21] Appl. No.: 08/787,354

[22] Filed: Jan. 22, 1997

Related U.S. Application Data

[63] Continuation-in-part of application No. 08/588,581, Jan. 18, 1996, abandoned.

[51] Int. Cl.[6] ..... G10D 13/02

[52] U.S. Cl. ..... 84/411 M

[58] Field of Search ..... 84/411 M, 411 P

[56] References Cited

U.S. PATENT DOCUMENTS 4,244,266 1/1981 Hardy ..... 84/411 M
4,325,281 4/1982 Hardy .
4,589,323 5/1986 Belli et al. .
4,899,635 2/1990 Santangelo ..... 84/411

FOREIGN PATENT DOCUMENTS

3436558A1 10/1984 Germany .
2217091A 10/1989 United Kingdom .

OTHER PUBLICATIONS

Falam Slam Bass Drum Pad, mfg. by Remo, Inc. (advertisement) no date.
Patch Bass Drum Impact Pad, mfg. by Evans Products (advertisement) no date.
Kickpad, mfg. by Aquarian (advertisement) no date.
Danmar Impact Pads,mfg. by Danmar (advertisement) (no date).
Eliminators Sound Absorption Polymer, mfg. by The Bohning Co. (advertisement) (no date).

*Primary Examiner*—Robert E. Nappi
*Assistant Examiner*—Shih-yung Hsieh
*Attorney, Agent, or Firm*—Michael R. McKenna

[57] ABSTRACT

An impact pad with a unique irregular shape that protects the drum head while allowing it to smoothly flex reducing drum head distortion for enhanced sound projection.

33 Claims, 6 Drawing Sheets

FIG. 1
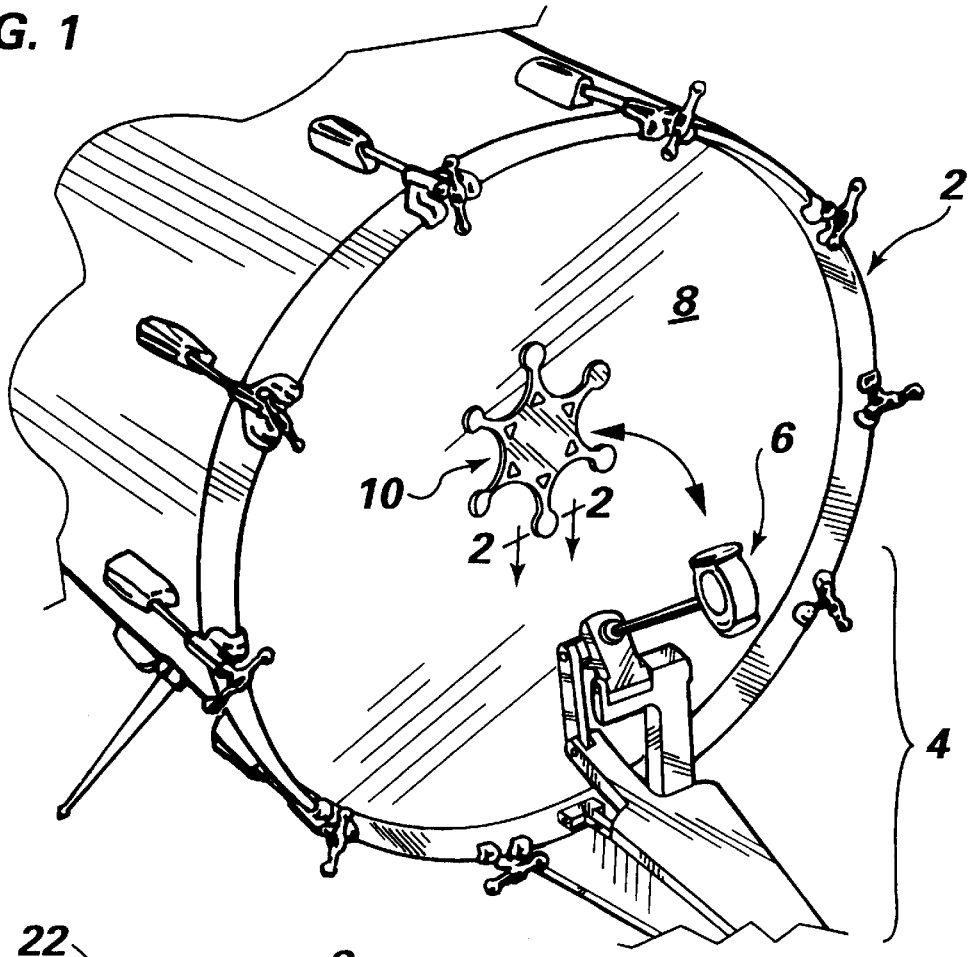
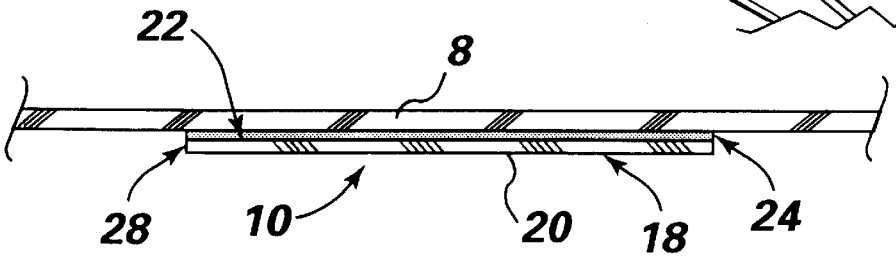
FIG. 2
FIG. 2A
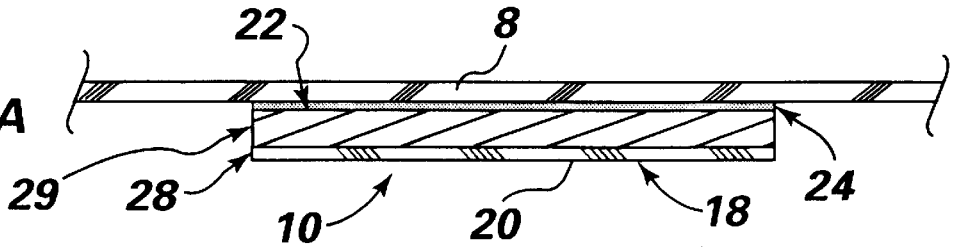

FIG. 3
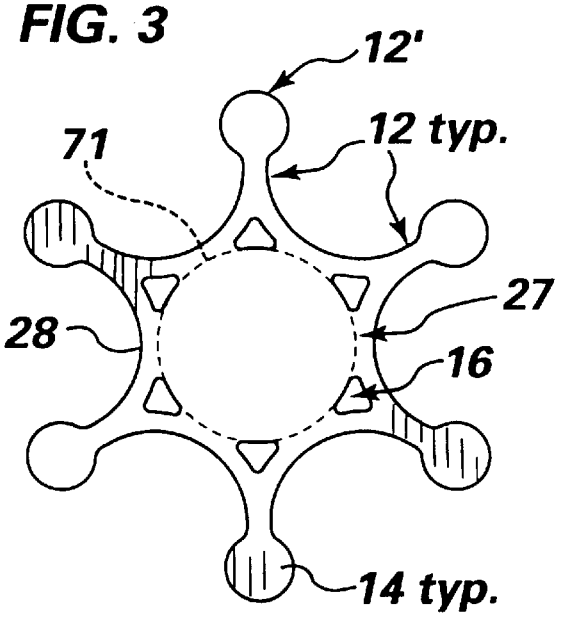
FIG. 4
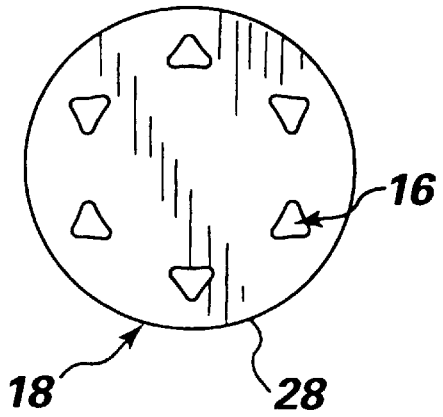
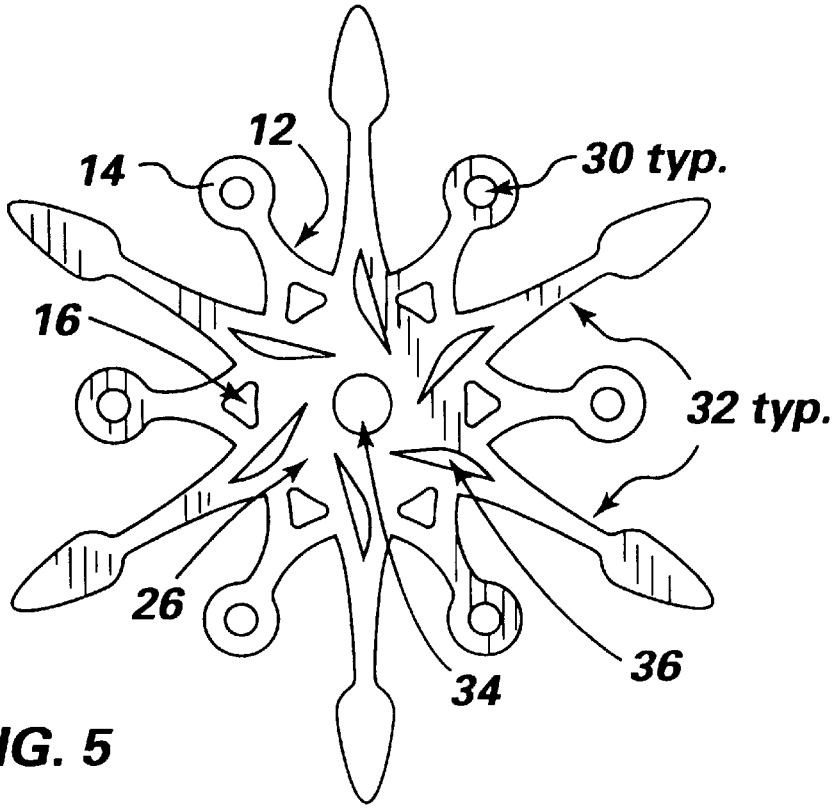
FIG. 5

IMPACT PAD FOR A DRUM HEAD

This application is a continuation-in-part, of application Ser. No. 08/588,581, filed Jan. 18, 1996, abandoned.

FIELD OF INVENTION

This invention relates to an impact pad for protecting a drum head and controlling sounds that occur when a drum head to which the impact pad is affixed is struck, comprising a generally flat sheet with an impact surface, an adhering surface, and an irregularly shaped peripheral edge. The irregularly shaped peripheral edge results from a plurality of radially extending arms.

An impact pad for a drum head having a plurality of radially extending arms emanating from a generally circular (or oblong for double beater playing) center section protects the drum head while allowing drum head flex and controlling sound by providing drum head movement during impact with a drum beater, stick, mallet, or other striking implement.

BACKGROUND OF THE INVENTION

Alternative technology is available in the form of a variety of impact pads, all of which are either circular or square for single drum beaters; oblong or rectangular for double drum beaters. See for example, the Evans patch bass drum impact pad, the Kickpad impact pad, and the Danmar kick pad. Also see the circular Eliminators™ sound absorption pad provided by the Bohning Company, Ltd. and the Falam Slam Bass Drum Pad manufactured by Remo, Inc., comprising a circular patch made of kevlar® woven fabric and mylar which is designed to extend the life of the bass drum head and produce a sharper, punchier bass drum sound.

Reference may also be made to German Patent DE 3,436,558 A1 for a multi-layered damping disc for drums consisting of polyethylene terephthalate film for supporting foam rubber layers. This multi-layered damping disc consists of a circular covering with the same diameter of the film skin forming a complete covering for the drum head.

U.S. Pat. No. 4,589,323 issued to Belli et al. in 1986 reveals a drum muffler for harmonically altering the overtones for a drum without reducing the sound comprising an insertable plastic support means to hold a layer of resilient foam against the underside of a drum head.

U.S. Pat. No. 4,899,635 issued to Santangelo in 1990 reveals a drum mute comprising a flexible resilient sheet which is adhered to the drum head. The underside of this sheet includes an adhesive to adhere to the drum head next to an area of felt. Said area of felt is elastically urged against the upper surface of the drum head to cause damping.

See also the drum head deadening device created by Hardy in U.S. Pat. Nos. 4,244,266 and 4,325,281.

According to the United Kingdom Patent GB 2,217,091 A issued in 1989 a circular rubber disc with adhesive backing to reduce noise is taught. The disc described is foam rubber sandwiched between thick rubber discs applied with adhesive on the outer bass drum head. The bass drum pad can be made in various shapes—squares or rectangles are suggested.

None of the foregoing devices teaches an irregular peripheral edge for controlling sound by a means which reduces drum head distortion while it provides drum head protection from denting, stretching, and damage from impact by beaters, drum sticks, mallets, and other instruments during play.

The impact pad of this important invention utilizes holes, arms, legs, nodes and/or rings to control drum instrument sound—to conduct, direct, guide, handle, manage or manipulate the drum head to produce sound.

Some of the drawbacks to these designs are that each teaches sharp peripheral edge structures which produce drum head discontinuities at impact pad edge. Moreover, none of the foregoing inventions is designed to spread the percussive energy radially by means of radiating arms. Because the impact pad of the instant invention has such arms and/or legs, its central area can be made smaller than the disc or rectangle of prior art devices which facilitates greater drum head flexibility and less sound distortion. The flat sheet of the impact pad comprises a central area which may be circular, square, rectangular, oval, oblong, or have an irregular shape.

To alleviate this problem, and others which will become apparent from the disclosure which follows, the present invention conveniently disburses the mass of the impact pad over a greater effective area without causing significant drum head distortion. Moreover, the arms/legs may be configured asymmetrically to direct percussive energy.

The citation of the foregoing publications is not an admission that any particular publication constitutes prior art, or that any publication alone or in conjunction with others, renders unpatentable any pending claim of the present application. None of the cited publications is believed to detract from the patentability of the claimed invention.

ADVANTAGES OF THIS INVENTION

Unlike the foregoing devices which teach rigid solid pads, the impact pad of the instant invention can be enhanced with a variable thickness of the central area and/or the radially extending arms, legs, or distal hands to affect sound quality. The thicker the impact pad, the less flex the drum head will have, which in turn, distorts the tones of the drum head. With the impact pad of the instant invention, the drum head flexes in a controlled manner, as determined by the impact pad shape.

The impact pad of the instant invention prevents drum head center stretch, increases sound projection as compared to the prior art devices and allows the drum head to flex with reduced distortion. The cut outs, holes, and apertures in the impact pad add flexure to the pad and thus allow the drum head to which it is attached to have greater flex.

The impact pads and damping discs referenced above are generally adhesively secured to the center of a drum head.

The unique shape of the impact pad of the instant invention interferes minimally with the flex of the drum head as compared to other "solid" shapes. Flexing of the drum head produces sound. Providing cutouts in the instant impact pad allows the impact pad to flex more easily with the head. Moreover, the drum head does not retain the shape of the impact pad from repeated use as with the "solid", more rigid impact pad. The extended arms of the device disclosed by this invention acts like a trampoline, flexing but returning to stasis after each impact.

The impact pad is not limited to bass drum use or the repeated impact of a single central contact point as with beaters in a fixed foot pedal position. The impact pad can be made into a variety of shapes having holes, arms, and legs, as described, that allow for variable drum head striking points as associated with the drum stick playing rudiments, patterns, styles of music for the snare, toms, and other drums.

It should be noted that the attachment of the impact pad to the drum head does not necessarily have to be permanent or affixed exclusively with adhesive. Vintage drums that have valuable, one of a kind calfskin heads would be an example of a need for temporary impact pad use. Other means of attachment, including temporary adhesives, may be employed. Practice would also be an example of temporary use when a drummer would use a muffled version (FIG. 2A) of the above mentioned impact pad as a "practice pad" that would have the natural feel of playing a drum head, but not necessarily require the full sound of the drum. It should also be noted that the impact pad as described in this disclosure could be made of a singular material that protects, muffles, and attaches all at the same time. For example, children's toys include "tacky plastic" toys that removably adhere to a surface, and an injection molded impact pad could have integral suction cups disposed on the adhering surface. Muffling the drum would also be additionally accomplished by the instant invention as shown in FIG. 2A, while still retaining the desired qualities that are taught by this impact pad invention.

With the impact pad of the instant invention sound projection is enhanced by keeping the contact point of the head from distorting from the contacting shape of the striking beater (or drum stick). Thicker materials may be used to increase the drum head sound characteristic "attack" which often gives the drum a "punchier" sound. Moreover, the extended arms of the instant impact pad reduce stretching of the head in the area to which it is applied.

All impact pads protect the drum head from the striking implement. The unique shape of the instant impact pad controls the sound of the drum in desirable ways. A reduced central area allows the head to which the impact pad is affixed to flex more naturally without the significant distortion caused by striking prior art solid impact pads.

All impact pads are primarily protective devices. The instant device, however, allows the drum to flex and vibrate as much as possible to preserve as close as possible the drums normal unmuffled tone. Consequently, sound production is diminished less compared to the solid prior art impact devices, because of the resilient quality of the polycarbonate material of which the instant impact pad is made, because of the cut outs or holes in the central area, and because of the extended flexible arms which effectively allow the central area of the instant invention to be smaller in size then comparable prior art solid impact pads.

These modified elements of the shape, size, and material of the impact pad of the instant invention allows for the production of desirable sound quality which may be desired by the musician. Different shapes and material thicknesses can enhance different sound qualities, in turn, the stiffer the material the less resonance of the drum head. More material coverage on the drum head, in turn, also deadens vibration producing a muffling effect. With the instant invention, the capability to direct drum head vibration by an array of projecting arms in one or more directions is a desirable quality to match a musicians's musical taste.

Sound characteristics of the drum are affected by the configuration of the impact pad. Larger or thicker impact pads are stiffer and in turn increase attack, which enhances the "punchiness" of the drum sound. The use of imbedded discs in the central area increases attack. Imbedding a disc in the hand or arm of the impact pad can be employed to absorb vibration which in turn dampens the drum sound, thus reducing "ringing" of the drum.

Prior art circular discs, and oblong and rectangular impact pads, are generally more rigid and their continuous peripheral edges imbed in the drum head. Whereas, the impact pad of the instant invention can be made to flex and not imbed in the drum head. The device of the instant invention can be a thinner, less stiff impact pad because of the drum head stretch preventative qualities of the projecting arms.

Still other advantages will be apparent from the disclosure that follows.

SUMMARY OF THE INVENTION

The invention relates to an impact pad for controlling sounds that occur when a drum head to which the impact pad is affixed is struck, comprising means for controlling distortion of the drum head including a generally flat sheet with an impact surface, an adhering surface, and an irregularly shaped peripheral edge. The impact pad has means for controlling the sound of the drum head.

The present invention discloses a central area of the flat sheet with at least one arm extending outwardly away from the central area. In some embodiments, extending arms are circumscribed by a circular ring giving the impact pad an irregular interior pattern and a regular peripheral edge. Furthermore, the impact pad may comprise a central area having at least one hole disposed in the central area.

BRIEF DESCRIPTION OF THE DRAWINGS

Preferred embodiments of the invention are described hereinafter with reference to the accompanying drawing wherein:

FIG. 1 is a perspective view of a first preferred embodiment of the impact pad of the present invention affixed to the drum head of a bass drum and also showing a drum beater and fragmentary view of a foot pedal assembly.

FIG. 2 is a cross-sectional view taken along the line 2—2 of FIG. 1 of a preferred embodiment of the present invention showing a layer of adhesive disposed on the adhering surface of the impact pad.

FIG. 2A is a cross-sectional view taken along the line 2—2 of FIG. 1 of a second preferred embodiment of the present invention showing a foam sheet disposed between a layer of adhesive and the adhering surface of the impact pad.

FIG. 3 is a top plan view of the first preferred embodiment of the impact pad showing a central area having holes and arms with distal hands extending from the central area.

FIG. 4 is a top plan view of a second preferred embodiment of the impact pad showing a central area having a plurality of holes disposed adjacent to the peripheral edge of the impact pad.

FIG. 5 is a top plan view of a third preferred embodiment of the impact pad showing a central area having holes and apertures, and arms, with distal hands some of which have hand holes, and legs extending from the central area.

DETAILED DESCRIPTION OF THE INVENTION

Figure 6:
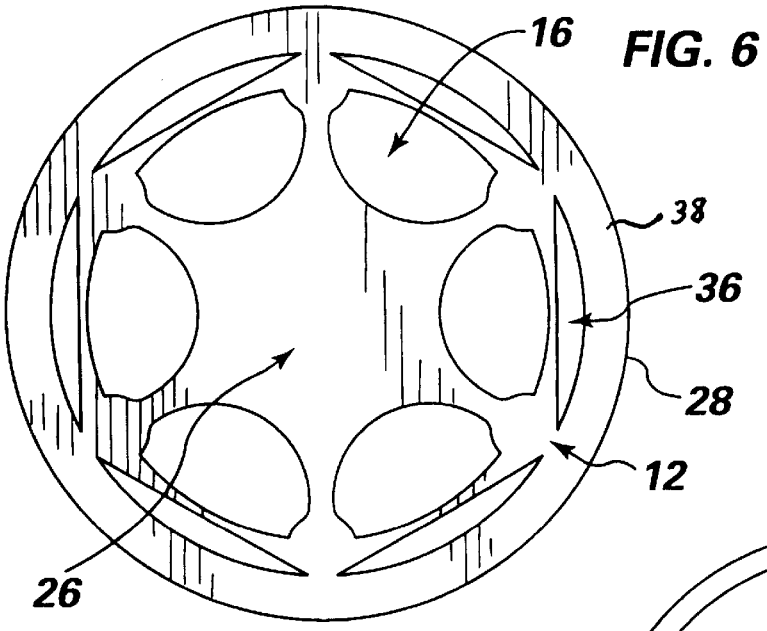
FIG. 6 is a top plan view of a fourth preferred embodiment of the impact pad showing a central area having symmetrically disposed holes and arms with distal ends extending from the central area with a circular ring connecting the distal end of the arms.

The preferred embodiments depicted in the drawing include an impact pad for controlling sounds that occur when a drum head to which the impact pad is affixed is struck, the impact pad comprising means for controlling distortion of the drum head including a generally flat sheet with an impact surface, an adhering surface, and an irregularly shaped peripheral edge. The impact pad has means for controlling the sound of the drum head.

The discussion that follows, without limiting the scope of the invention, will refer to the invention as depicted in the drawing, showing embodiments of an apparatus that will accommodate striking implements, particularly, single or double beaters. In a preferred embodiment for double beater drum play as shown in FIG. 11, the flat sheet of the impact pad comprises a central elongated area 50 having a first arcuate end 58 and a second arcuate end 59, said central elongated area 50 having two half images (60 and 62, respectively), each half image having an identical peripheral edge and arcuate ends (58 and 59, respectively), the first arcuate end 58 has a uniform radius of curvature emanating from a first central point 64 and the second arcuate end 59 has a uniform radius of curvature emanating from a second central point 66, at least one of the arcuate ends has at least one arm 12 extending beyond the arcuate end radially outward away from the central point associated with the radius of curvature of the arcuate end, thereby defining the irregularly shaped peripheral edge.

The impact pad may have at least one of the arms 12 extending beyond the radius of curvature of the arcuate end (or central circular area) which has a distal end with a circular hand 14 disposed on the distal end.

Figure 11:
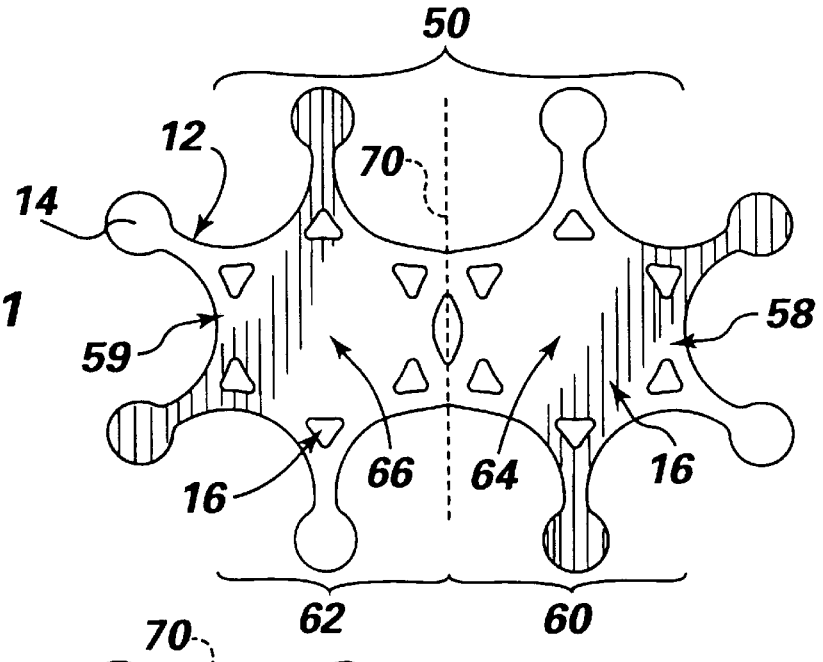
FIG. 11 is a top plan view of a ninth preferred embodiment of the impact pad showing an elongated central area having holes disposed radially relative to two distinct points in the central area and arms with distal hands extending from the two distinct points in the central area.
Figure 11A:
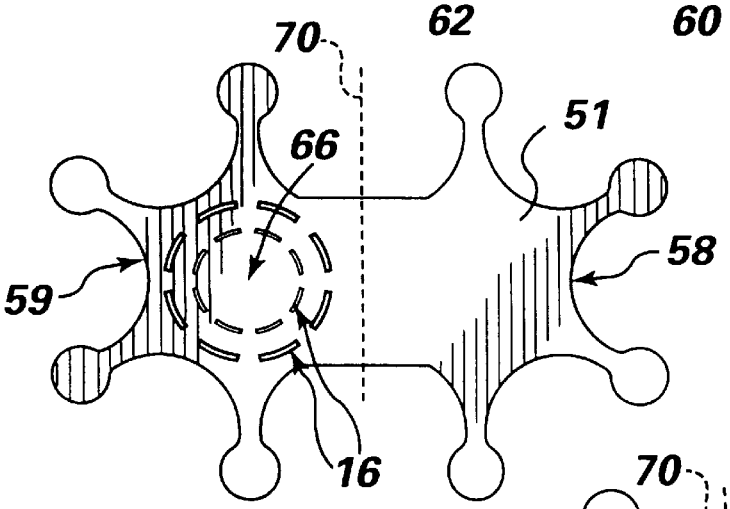
FIG. 11A is a top plan view of a tenth preferred embodiment of the impact pad showing an elongated central area having holes disposed on one side thereof and arms with distal hands extending from two distinct points in the central area.
Figure 12:
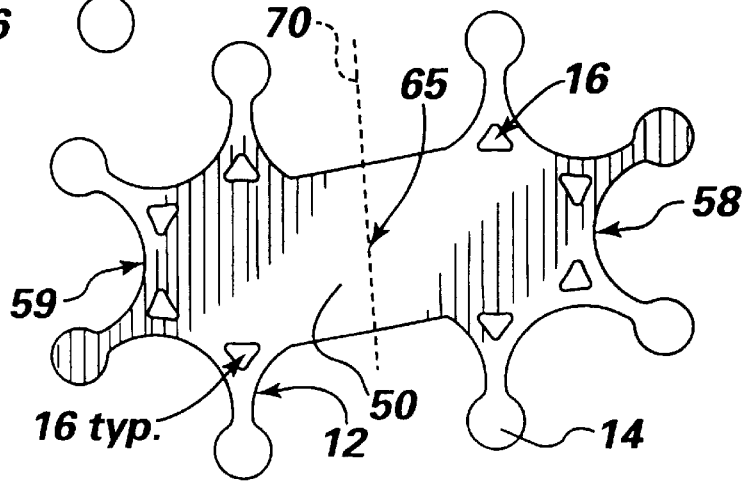
FIG. 12 is a top plan view of an eleventh preferred embodiment of the impact pad showing an offset elongated central area having holes and arms with distal hands radiating from two distinct points in the central area.
Figure 13:
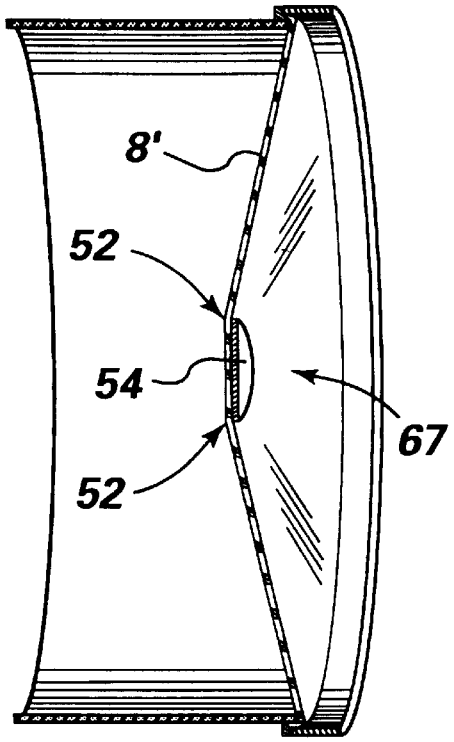
FIG. 13 is a fragmentary side elevation view of a drum with a prior art impact pad affixed to an impacted drum head showing drum head discontinuities at the edge of the prior art impact head.
Figure 16:
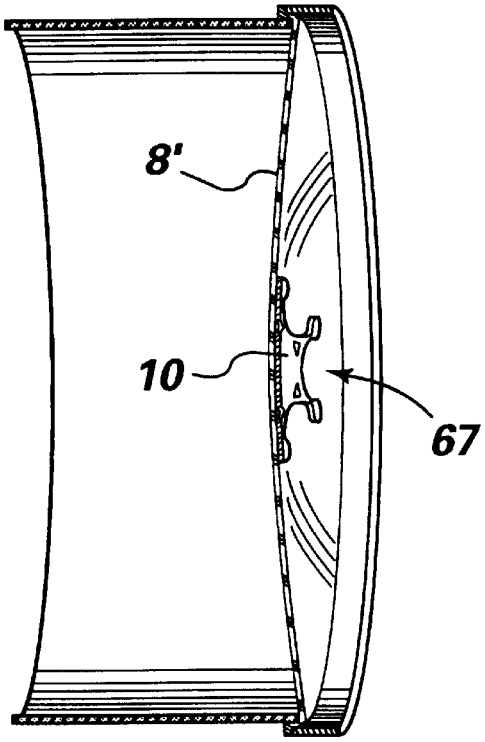
FIG. 16 is a fragmentary side elevation view of a drum with a preferred embodiment of an impact pad of the present invention affixed to a smooth impacted drum head.
Figure 14:
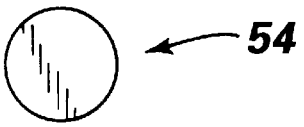
FIG. 14 is a top plan view of a circular prior art impact pad shown in FIG. 13.
Figure 17:
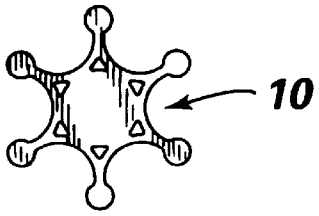
FIG. 17 is a top plan view of the impact pad of the present invention shown in FIG. 16.
Figure 15:
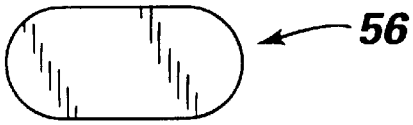
FIG. 15 is a top plan view of an oblong prior art impact pad.

In the preferred embodiment for a double beater as shown in FIGS. 11, 11A, and 12, the impact pad has a plurality of holes disposed in the central elongated area 50.

In another preferred embodiment of the impact pad of the present invention as shown in FIG. 11, at least one of the arcuate ends has a plurality of holes 16 arranged symmetrically about the central point 66 associated with the radius of curvature of the arcuate end 59.

As shown in FIGS. 11 and 12, each of the arcuate ends (58 and 58, respectively) has a plurality of arms 12 extending beyond the arcuate end radially outward away from the central point associated with the radius of curvature of the arcuate end. The flat sheet of the impact pad 10 further is symmetrical about a line of symmetry 70 defining two half sheets images (60 and 62, respectively), each half sheet image having an identical peripheral edge. As shown in FIG. 11, the line of symmetry 70 is perpendicular to the longitudinal centerline of the central elongated area 50.

The instant invention also includes configurations of the impact pad for double beaters which include not only identical mirror image configurations but configurations where one beater hits a solid central area and the other is made to contact a central area having a plurality of holes. As shown in FIG. 11A, the side with the plurality of holes should be understood to flex more than the other side (bordered by first arcuate end 58) and therefore produce two different tones for the drummer.

In another preferred embodiment of the impact pad of the present invention, as shown in FIG. 12, the line of symmetry 70 is askew to the longitudinal centerline of the central elongated area 50 and one of the half sheet images may be rotated 180° about a central point 65 on the line of symmetry 70 between the two half images to form a mirror image of the other half sheet image. The off set double beater version shown in FIG. 12 compensates for a shorter beater rod length and/or a slower, weaker drummer's foot. The shorter moment arm of the beater produces more speed.

In the preferred embodiment of the impact pad of the present invention, as shown in FIG. 11A, only one of the half sheet images on one side of the line of symmetry 70 has a plurality of holes 16 arranged symmetrically about the central point 66 associated with the radius of curvature of the arcuate end 59. These holes will allow one beater to produce a different sound—the side having the holes producing lower tones since that side will be more flexible and less attack will occur.

As best shown in FIG. 3, the flat sheet of the impact pad comprises a central area 71 with at least one arm extending outwardly away from the central area. The circular central disk 42 of FIG. 10 may be configured in an impact pad with a flat sheet comprising a circular central disk 42 with at least one arm 12 extending beyond the central disk radially outward away from the center of the central disk 42. In FIG. 3, a plurality of arms extending outwardly away from a central point in the central area 71 are shown. Moreover, another preferred embodiment has the central area having at least one hole disposed in the central area. FIG. 3 shows the arms and the holes arranged symmetrically about the central circular area. In the preferred embodiment of the impact pad of the present invention, as shown in FIG. 3, each of the arms has at least one medially disposed hole 16. Moreover, each of the arms 12 has a distal end 12' with a hand 14 disposed on the distal end 12'. As shown in FIG. 3, each of the hands 14 may have a circular shape.

As best shown in FIG. 2, the impact pad 10 for controlling sounds that occur when a drum head 8 to which the impact pad 10 is affixed is struck, the impact pad comprising means for controlling the sound of the drum head including a generally flat sheet 18 with an impact surface 20, an adhering surface 22, a peripheral edge 28, and at least one hole 16 (as shown in FIG. 4) disposed adjacent to the peripheral edge 28.

In the preferred embodiment of the impact pad of the present invention, as shown in FIG. 2A, a foam sheet 29 disposed on the adhering surface may be employed as a "practice pad", that would have the natural feel of playing a drum head, but not necessarily require the full sound of the drum. Muffling the drum would also be additionally accomplished by the instant invention as shown in FIG. 2A, while still retaining the desired qualities that are taught by this impact pad invention.

In the preferred embodiment of the impact pad of the present invention, as shown in FIG. 4, the impact pad comprises means for controlling the sound of the drum head including a generally flat sheet 18 with an impact surface, an adhering surface, a peripheral edge 28, and at least one hole 16 disposed adjacent to the peripheral edge 28. The peripheral edge 28 is circular. As shown, the holes 16 are symmetrically arranged about the center of the central disk and proximate to the peripheral edge 28.

Figure 7:
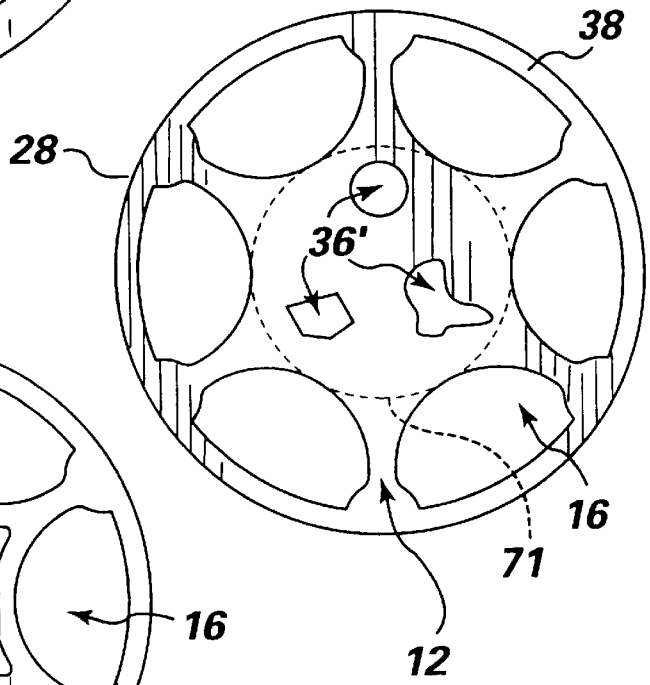
FIG. 7 is a top plan view of a fifth preferred embodiment of the impact pad showing a central area having various shaped holes and arms with distal ends extending from the central area with a circular ring connecting the distal end of the arms.

In another preferred embodiment of the impact pad of the present invention, as shown in FIGS. 6 and 7, the impact pad comprises means for controlling the sound of the drum head including a generally flat sheet comprising a circular central disk with an impact surface, an adhering surface, a peripheral edge 28, and a plurality of holes 16 disposed in the central disk.

Figure 9:
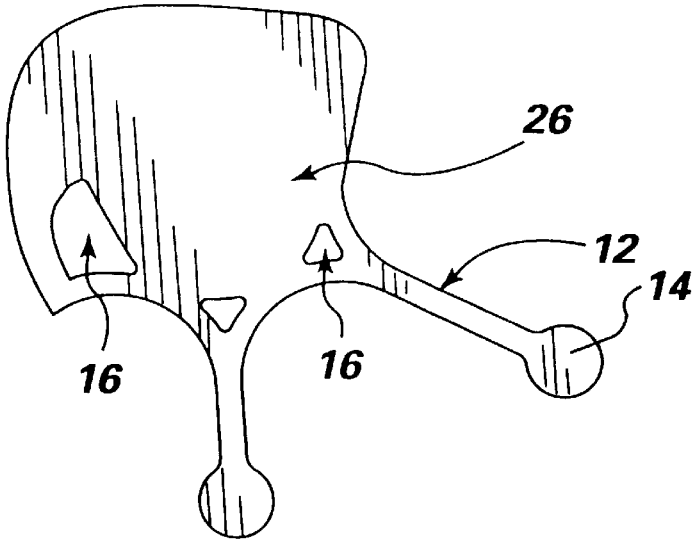
FIG. 9 is a top plan view of a seventh preferred embodiment of the impact pad showing a central area having holes and asymmetrical arms with distal ends extending from the central area.

In another preferred embodiment of the impact pad of the present invention, as shown in FIG. 9, the impact pad has holes 16 asymmetrically arranged about the center of the central disk.

As best shown in FIG. 7, the impact pad has holes 16 of similar shape and size and further comprises a plurality of openings 36' of assorted shapes and sizes asymmetrically arranged about the center of the central disk 71.

In another preferred embodiment of the impact pad of the present invention, as shown in FIG. 6, the impact pad comprises holes 16 of similar shape and size and further comprises a plurality of openings 36 of similar shape and size symmetrically arranged about the center of the central disk. Moreover, an embodiment of FIG. 6 shows the holes 16 are of similar shape and size, and the impact pad further comprises a like number of openings 36, each of the openings is of similar shape and size, and each opening 36 is radially aligned with one of the holes 16 about the center of the central disk.

Figure 8:
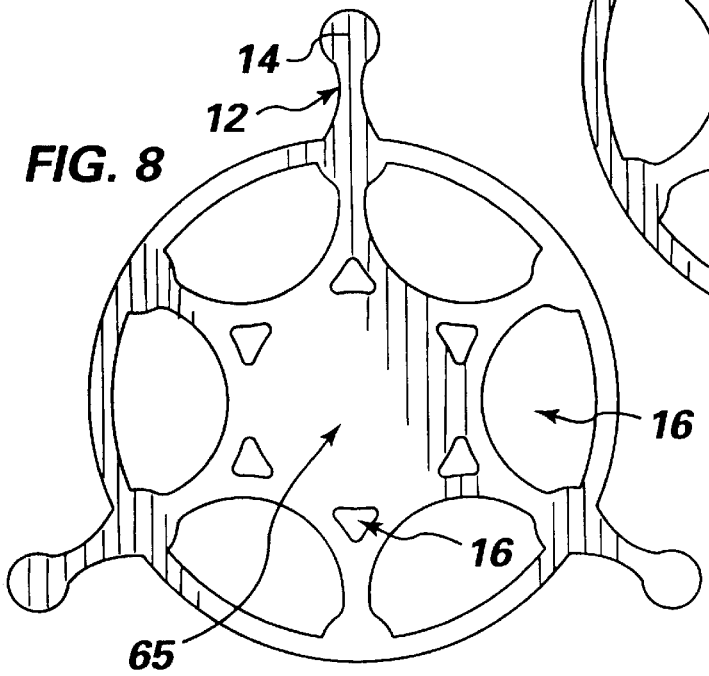
FIG. 8 is a top plan view of a sixth preferred embodiment of the impact pad showing a central circular area having holes and arms with distal hands extending from a central circular area.

In another preferred embodiment, as shown in FIG. 8, the impact pad further comprises a plurality of arms 12 extending beyond the central disk radially outward away from the center 65 of the central disk.

In another preferred embodiment of the impact pad of the present invention, as shown in FIG. 5, the flat sheet further comprises a plurality of legs 32 extending outwardly away from the central area 26, each of the legs 32 being interpolatively disposed between adjacent arms 12. Alternatively, the arms could be interpolatively disposed between adjacent legs.

In another preferred embodiment of the impact pad of the present invention, as shown in FIG. 8 the flat sheet is symmetrical about a centerline of only one of the arms.

Figure 10:
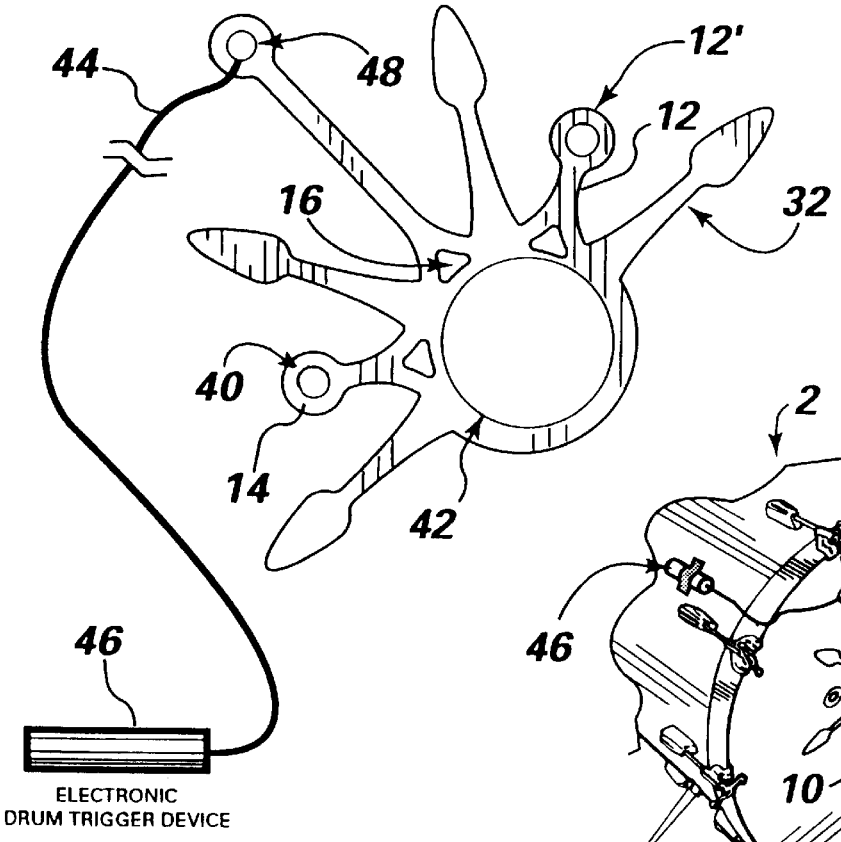
FIG. 10 is a top plan view of an eighth preferred embodiment of the impact pad showing a central area of thickened material (which may include a circular disc) having holes, and asymmetrical legs extending from the central area with radially extending arms with distal hands, some of said hand being thickened (which may include a circular disc or a contact for an electronic drum trigger).

The impact pad of the present invention is preferably made of clear polycarbonate twenty thousandth (0.020") of an inch in thickness with the adhering surface comprising 3M adhesive on a removable paper sheet which protects the adhesive prior to removal for application. Alternatively, the adhering surface of the impact pad could be adhesiveless. Colored graphics are printed on the adhering surface 22 which are viewable through the flat clear polycarbonate sheet and protected by its placement. The configuration of the impact pad is achieved with die cutting to allow for the extending arms to flex along with the central area with holes, thereby enhancing the impact pad's flexibility. The impact pad may have at least one of the distal ends of the arms with an enhanced thickness, whereby sounds that occur when a drum head to which the impact pad is affixed is struck are controlled. As best shown in FIG. 10, the central area of the flat sheet may comprise a circular central disk 42 with an enhanced thickness. Thickening the impact pad tends to increase the attack of the drum head to which it is affixed. In one preferred embodiment, the flat sheet of the impact pad may have a central disk 42 with a plurality of arms 12 extending beyond the central disk radially outward away from the center of the central disk. A preferred embodiment includes at least a portion of the central disk having an enhanced thickness, whereby sound is moderated.

The preferred embodiment shown in FIG. 3 of the drawing may be appropriately sized and employed for any drum. However, the preferred dimensions of this embodiment for a bass drum are a central impact surface area 71 of FIG. 3 is approximately one and 27/32nds of an inch, with an overall length having a dimension taken through the center of the central area 71 and through the oppositely disposed arms, of approximately 7 and 5/16ths of an inch.

Moreover, the thickness of the impact pad can be reduced for smaller drums such as a Tom-Tom Drum with a thickness of about 0.010", whereas for a Bass Drum the thickness is about 0.020", with the understanding that any thickness in said range will work as well.

Moreover, the polycarbonate material of the preferred embodiment establishes the thickness range. The thickness limits for polycarbonate are known manufacturing tolerances for a die-cut impact pad which is the preferred method now known for an impact pad made of polycarbonate. Tolerances will obviously vary with other known materials.

It should be noted that a specific prototype of said FIG. 3, with dimensions that are now set forth above, was filed with the original application.

The other configurations shown in the remaining figures of the drawing are of approximately the same general size as that of FIG. 3, but can be enlarged or made smaller to accommodate the head of varying drum heads and may be varied to achieve a subjective sound result.

Similarly, the arms can be augmented. The thickness of the hand of the arm can be enhanced in its central section 40 in order to achieve a desired sound. Additionally, the hand could be varied in size. Materials for other impact pads have been constructed of leather, mylar, mylar with a metal disc sandwiched therein, rubberized fabric and Kevlar® woven fabric. The preferred material for the present invention is polycarbonate sheet, such as Lexan®.

Figure 10A:
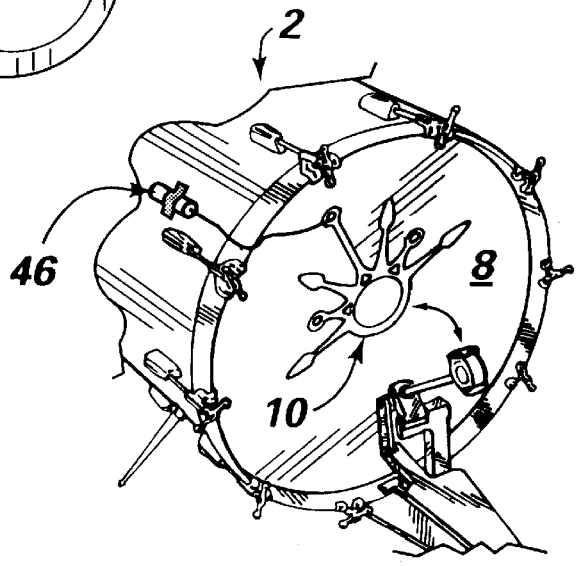
FIG. 10A is a perspective view of the eighth preferred embodiment of the impact pad of FIG. 10 shown affixed to the drum head of a bass drum and also showing a fragmentary view of a foot pedal drum beater assembly and electronic drum trigger mounted on the drum.

In the preferred embodiment of the impact pad of the present invention, as shown in FIG. 10, each of the arms 12 has a distal end 12' with a hand 14 disposed on the distal end 12', and wherein at least one of the hands 14 has an enhanced thickness 40, whereby sounds that occur when a drum head, to which the impact pad is affixed is struck, are controlled. An electronic drum triggering device 46 such as the Hexabug distributed by Simmons Services of West Hills, Calif., may be placed in operative association with various elements, such as a hand, a thickened hand, a leg, the central area, a thickened central area, a central disk, etc. to achieve a desired effect. See FIGS. 10 and 10A, where an electronic drum trigger is shown in operative association with a thickened hand of the impact pad. By radiating inner sound and vibration along the path of the extended arm, a vibratory electronic drum trigger such as those manufactured by Simmons can be placed on the selected hand, arm, or foot of the impact pad to activate an electronic signal based on a controlled vibration.

One embodiment of the invention shown in FIG. 6 shows an external ring 38 which limits the generation of tones and produces a muffling effect. The greater the size of the ring, the more muffling of tones occur. Whereas, with extended arms and the smaller central disc of FIG. 3, a trampoline effect takes place making impact vibrations and fundamental tones of the drum head remain true. The asymmetric arms of the single pad of FIGS. 9 and 10 direct the energy from the beater contact with the impact pad producing a projection and radiation of sound energy in a controlled direction. This direction of energy can be used to augment or attenuate internal muffling of the drum. Typically bass drums are internally muffled by the inclusion of a pillow inside the bass drum which pillow, by gravity, sinks to the bottom of the drum leaving a bottom muffled sound pattern for the drum. The asymmetric impact pad can assist in enhancing or correcting this disparity depending on a musician's sound requirements from the instrument.

The embodiment of the invention shown in FIG. 6 includes a generally flat sheet with an impact surface, an adhering surface, a peripheral edge, a plurality of holes, and a central area having a plurality of arms projecting radially outward from the central area, each of said arms disposed as a circular ring segment between adjacent apertures, each of said arms having a distal end and the distal ends of the arms are connected by a circular ring. As best shown in FIG. 6 of the drawing, the present invention provides a central area 26 having a plurality of arms 12, disposed as a circular ring segment between adjacent apertures 36, bounded by a circular ring 38. That is, each of the arms 12 has a distal end and the distal ends of the arms 12 are connected. Alternatively, the impact pad shown in FIGS. 6 and 7 could be seen as circular shaped impact pads with various openings.

As shown in FIGS. 6 and 7, the arms 12, disposed as a circular ring segment between adjacent apertures 36, are symmetrically arranged about the center of the central disk. Moreover, a plurality of holes 16 disposed in the central area 26 are shown.

In the preferred embodiment of the impact pad of the present invention, as shown in FIG. 5, the flat sheet further comprises a plurality of legs 32 extending beyond the central disk radially outward away from the center of the central disk, each of the legs being interpolatively disposed between adjacent arms 12. A variant of preferred embodiments of the invention, as shown in FIG. 5, include an aperture 34 disposed in the center of the central disk.

Moreover, the impact pad of the instant invention is an improved impact pad, for controlling sounds that occur when a drum head to which the impact pad is affixed is struck, having a generally flat sheet with an impact surface, an adhering surface, and a peripheral edge, wherein the improvement comprises means for controlling distortion of the drum head including the peripheral edge that is irregularly shaped. The improvement comprises means for controlling the sound of the drum head including the peripheral edge that is irregularly shaped.

While this invention has been described in connection with the best mode presently contemplated by the inventor for carrying out his invention, the preferred embodiments described and shown are for purposes of illustration only, and are not to be construed as constituting any limitations of the invention. Modifications will be obvious to those skilled in the art, and all modifications that do not depart from the spirit of the invention are intended to be included within the scope of the appended claims.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientist, engineers and practitioners in the art who are not familiar with patent or legal terms of phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An impact pad for controlling sounds that occur when a drum head to which the impact pad is affixed is struck, said impact pad comprising means for controlling the sound of the drum head including a generally flat sheet with an impact surface, an adhering surface, and an irregularly shaped peripheral edge, wherein the flat sheet comprises a central elongated area having first arcuate end and a second arcuate end, the first arcuate end has a uniform radius of curvature emanating from a first central point and the second arcuate end has a uniform radius of curvature emanating from a second central point, at least one of said arcuate ends has at least one arm extending beyond said arcuate end radially outward away from the central point associated with the radius of curvature of said arcuate end, thereby defining the irregularly shaped peripheral edge.

2. The impact pad of claim 1, wherein at least one of the arms extending beyond the radius of curvature of the arcuate end has a distal end with a circular hand disposed on said distal end.

3. The impact pad of claim 1, wherein a plurality of holes are disposed in the central elongated area.

4. The impact pad of claim 1, wherein at least one of said arcuate ends has a plurality of holes arranged symmetrically about the central point associated with the radius of curvature of said arcuate end.

5. The impact pad of claim 4, wherein each of the arcuate ends has a plurality of arms extending beyond said arcuate end radially outward away from the central point associated with the radius of curvature of said arcuate end, and wherein the flat sheet is symmetrical about a line of symmetry defining two half sheets images, each half sheet image having an identical peripheral edge.

6. The impact pad of claim 5, wherein the line of symmetry is perpendicular to the longitudinal centerline of the central elongated area.

7. The impact pad of claim 5, wherein the line of symmetry is askew to the longitudinal centerline of the central elongated area and wherein one of the half sheet images may be rotated 180° about a central point on the line of symmetry to form a mirror image of the other half sheet image.

8. The impact pad of claim 5, wherein only one of the half sheet images on one side of the line of symmetry has a plurality of holes arranged symmetrically about the central point associated with the radius of curvature of said arcuate end.

9. An impact pad for enhancing sounds that occur when a drum having a drum head to which the impact pad is affixed is struck, said impact pad comprising means for enhancing the sound of the drum including a generally flat sheet with a generally central impact surface for receiving a sound producing strike, an adhering surface for mounting on a striking surface of the drum head, and means for enhancing sound projection including an irregularly shaped peripheral edge, wherein the flat sheet comprises a central area with at least one arm extending outwardly away from the central area and with at least one hole disposed outside said central area.

10. An impact pad for controlling sounds that occur when a drum head to which the impact pad is affixed is struck, said impact pad comprising means for controlling the sound of the drum head including:

a generally flat sheet with a generally central impact surface, said flat sheet comprises a central area with a plurality of arms extending outwardly away from the central area, the flat sheet further comprises a plurality of legs extending outwardly away from the central area, each of said arms being interpolatively disposed between adjacent legs, an adhering surface, and an irregularly shaped peripheral edge.

11. An impact pad for controlling sounds that occur when a drum head to which the impact pad is affixed is struck, said impact pad comprising means for controlling the sound of the drum head including:

a generally flat sheet with a generally central impact surface, said flat sheet comprises a central area with a plurality of arms extending outwardly away from the central area, the flat sheet further comprises a plurality of legs extending outwardly away from the central area, each of said legs being interpolatively disposed between adjacent arms, an adhering surface, and an irregularly shaped peripheral edge.

12. The impact pad of claim 11, wherein the central area comprises a circular central disk with an enhanced thickness.

13. An impact pad for controlling sounds that occur when a drum head to which the impact pad is affixed is struck, said impact pad comprising means for controlling the sound of the drum head including:

a generally flat sheet with a generally central impact surface, said flat sheet comprises a central area with a plurality of arms extending outwardly away from the central area, the flat sheet is symmetrical about a centerline of only one of the arms, an adhering surface, and an irregularly shaped peripheral edge.

14. An impact pad for controlling sounds that occur when a drum head to which the impact pad is affixed is struck, said impact pad comprising means for controlling the sound of the drum head including:

a generally flat sheet with a generally central impact surface, said flat sheet comprises a central area with a plurality of arms extending outwardly away from the central area, each of the arms has a distal end with a hand disposed on said distal end, and wherein at least one of the hands has an enhanced thickness, whereby sounds that occur when a drum head to which the impact pad is affixed is struck are controlled, an adhering surface, and an irregularly shaped peripheral edge.

15. An impact pad for controlling sounds that occur when a drum head to which the impact pad is affixed is struck, said impact pad comprising means for controlling the sound of the drum head including a generally flat sheet with a generally central impact surface, an adhering surface, and an irregularly shaped peripheral edge, said flat sheet comprises a circular central disk with at least one arm extending beyond the central disk radially outward away from the center of said central disk, and wherein at least a portion of the central disk has an enhanced thickness, whereby sound is moderated.

16. An impact pad for controlling sounds that occur when a drum head to which the impact pad is affixed is struck, said impact pad comprising means for controlling the sound of the drum head including a generally flat sheet with a generally central impact surface, an adhering surface, and an irregularly shaped peripheral edge, said flat sheet comprises a central disk with a plurality of arms extending beyond the central disk radially outward away from the center of said central disk, and wherein each of the arms has a distal end and the distal ends of the arms are connected.

17. An impact pad for controlling sounds that occur when a drum head to which the impact pad is affixed is struck, said impact pad comprising means for controlling the sound of the drum head including a generally flat sheet with a generally central impact surface, an adhering surface, and an irregularly shaped peripheral edge, said flat sheet comprises a central disk with a plurality of arms extending beyond the central disk radially outward away from the center of said central disk, said arms are symmetrically arranged about the center of the central disk, and wherein each of the arms has at least one medially disposed hole.

18. An impact pad for controlling sounds that occur when a drum head to which the impact pad is affixed is struck, said impact pad comprising means for controlling the sound of the drum head including a generally flat sheet with a generally central impact surface, an adhering surface, and an irregularly shaped peripheral edge, said flat sheet comprises a central disk with a plurality of arms extending beyond the central disk radially outward away from the center of said central disk, said arms are symmetrically arranged about the center of the central disk, and wherein each of the arms has a distal end with a hand disposed on said distal end.

19. The impact pad of claim 18, wherein each of the hands is circularly shaped.

20. The impact pad of claim 18, wherein at least one of the distal ends of the arms has an enhanced thickness, whereby sounds that occur when a drum head to which the impact pad is affixed is struck are controlled.

21. An impact pad for controlling sounds that occur when a drum head to which the impact pad is affixed is struck, said impact pad comprising means for controlling the sound of the drum head including a generally flat sheet with a generally central impact surface, an adhering surface, and an irregularly shaped peripheral edge, said flat sheet comprises a central disk with a plurality of arms extending beyond the central disk radially outward away from the center of said central disk, and wherein the flat sheet further comprises a plurality of legs extending beyond the central disk radially outward away from the center of said central disk, each of said legs being interpolatively disposed between adjacent arms.

22. The impact pad of claim 19, wherein an aperture is disposed in the center of the central disk.

23. An impact pad for enhancing sounds that occur when a drum having a drum head to which the impact pad is affixed is struck, said impact pad comprising means for enhancing the sound of the drum including a generally flat sheet with a generally central impact surface for receiving a sound producing strike, an adhering surface for mounting on a striking surface of the drum head, a peripheral edge, and means for enhancing sound projection including at least one hole disposed adjacent to the peripheral edge, wherein the flat sheet comprises a central area with at least one hole disposed outside said central area.

24. An impact pad for controlling sounds that occur when a drum head to which the impact pad is affixed is struck, said impact pad comprising means for controlling the sound of the drum head including a generally flat sheet comprising a circular central disk with an impact surface, an adhering surface, a peripheral edge, and a plurality of holes disposed in said central disk.

25. The impact pad of claim 24, wherein the holes are symmetrically arranged about the center of the central disk and proximate to the peripheral edge.

26. The impact pad of claim 25, wherein the holes are of similar shape and size, and wherein the impact pad further comprises a like number of openings, each of said openings are of similar shape and size, and each opening is radially aligned with one of the holes about the center of the central disk.

27. The impact pad of claim 25, wherein the holes are of similar shape and size, and wherein the impact pad further comprises a plurality of openings of similar shape and size symmetrically arranged about the center of the central disk.

28. The impact pad of claim 27, further comprising a plurality of arms extending beyond the central disk radially outward away from the center of said central disk.

29. The impact pad of claim 24, wherein the holes are asymmetrically arranged about the center of the central disk.

30. The impact pad of claim 25, wherein the holes are of similar shape and size, and wherein the impact pad further comprises a plurality of openings of assorted shapes and sizes asymmetrically arranged about the center of the central disk.

31. An impact pad for controlling sounds that occur when a drum head to which the impact pad is affixed is struck, said impact pad comprising means for controlling the sound of the drum head including a generally flat sheet with an impact surface, an adhering surface, a peripheral edge, a plurality of holes, and a central area having a plurality of arms projecting radially outward from the central area, each of said arms disposed as a circular ring segment between adjacent holes, each of said arms having a distal end and the distal ends of the arms are connected by a circular ring.

32. An impact pad for controlling sounds that occur when a drum head to which the impact pad is affixed is struck, said impact pad comprising means for controlling the sound of the drum head including a generally flat sheet with a generally central impact surface, an adhering surface, and an irregularly shaped peripheral edge, wherein the flat sheet comprises a central area with a plurality of arms extending outwardly away from the central area, said plurality of arms including at least two arms extending outwardly along a line passing through the central area with an overall dimension taken along said line on the order of 5 and 5/16ths inches and a diameter of the central area on the order of 1 and 27/32nds inches.

33. An impact pad for controlling sounds that occur when a drum head to which the impact pad is affixed is struck, said impact pad comprising means for controlling the sound of the drum head including a generally flat sheet with a generally central impact surface, an adhering surface, and an irregularly shaped peripheral edge, having a thickness in the range of 0.010" to 0.020".

* * * * *